US008241078B2

(12) United States Patent
Tsuji

(10) Patent No.: US 8,241,078 B2
(45) Date of Patent: Aug. 14, 2012

(54) MALE TERMINAL FITTING WITH A REDUCED SPACE PORTION

(75) Inventor: Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/023,564

(22) Filed: Feb. 9, 2011

(65) Prior Publication Data

US 2011/0207374 A1 Aug. 25, 2011

(30) Foreign Application Priority Data

Feb. 25, 2010 (JP) ..... 2010-039905

(51) Int. Cl.
*H01R 13/02* (2006.01)

(52) U.S. Cl. ..... 439/884

(58) Field of Classification Search ..... 439/884, 439/595, 598, 752, 744, 871, 885
See application file for complete search history.

(56) References Cited

U.S. PATENT DOCUMENTS

| | | | | |
|---|---|---|---|---|
| 5,211,589 | A * | 5/1993 | McCardell | 439/879 |
| 5,681,190 | A * | 10/1997 | Childs | 439/856 |
| 6,398,599 | B1 | 6/2002 | Irikura et al. | |
| 6,659,813 | B2 * | 12/2003 | Sai | 439/884 |
| 7,238,064 | B2 * | 7/2007 | Nakamura et al. | 439/884 |
| 7,517,247 | B2 * | 4/2009 | Hiramatsu | 439/595 |
| 7,785,160 | B2 * | 8/2010 | Shimizu | 439/852 |
| 2008/0305681 | A1 * | 12/2008 | Hiramatsu | 439/595 |

* cited by examiner

*Primary Examiner* — Chandrika Prasad
(74) *Attorney, Agent, or Firm* — Gerald E. Hespos; Michael J. Porco

(57) ABSTRACT

A male terminal fitting includes a tab that is connectable with a counterpart female terminal fitting. A tubular body is behind the tab and has an opening for receiving a lance. A barrel is behind the body and is crimped to an end portion of an electric wire. Side walls between the barrel and the tab in the longitudinal direction are hammered in to form a reduced space portion. The reduced space portion has an opening smaller than a thickness and a width of the tab to prevent the tab of another male terminal fitting from intruding through the opening and into the body. Thus, the male terminal fitting prevents the entanglement of male terminal fittings without making the structure of the male terminal fitting complicated.

11 Claims, 12 Drawing Sheets

MALE TERMINAL FITTING WITH A REDUCED SPACE PORTION

BACKGROUND OF THE INVENTION

1. Field of the Invention

The invention relates to a male terminal fitting.

2. Description of the Related Art

U.S. Pat. No. 6,398,599 discloses a male terminal fitting that is formed by bending an electrically conductive metal sheet or the like. The terminal fitting includes a tab, a body and a barrel. The tab projects frontward and is connectable to a female terminal fitting. The body is formed defines a tube that is contiguous with a rear end of the tab, and an opening is formed in an intermediate portion of the body. The opening in the body is configured to receive a locking lance of a connector housing when the body is inserted into a cavity of the housing. The barrel is rearward of the body and is crimped into connection with an end portion of an electric wire.

The male terminal fitting disclosed in U.S. Pat. No. 6,398,599 also has a restricting member that partially closes the opening in the body. The restricting member prevents the tab of another male terminal fitting from intruding into the body through the opening and hence prevents entanglement of the male terminal fittings.

The body of the male terminal fitting of U.S. Pat. No. 6,398,599 has double walls and the restricting member is formed by bending an extending portion of the inner wall. Accordingly, extra metal is required to form the restricting member and the structure of the terminal fitting becomes complicated. The restricting member could be formed by cutting a wall of the body and raising the cut portion. However, a hole would be formed in the wall by this forming process and a tab could intrude into the body through the hole.

The invention has been made in view of the above-mentioned circumstances, and an object of the invention is to provide a simple male terminal fitting that prevents entanglement of male terminal fittings.

SUMMARY OF THE INVENTION

The invention relates to a male terminal fitting formed of an electrically conductive metal sheet. The terminal fitting has a tab, a body and a barrel. The tab is connectable with a counterpart female terminal fitting. The body is behind the tab and is formed into a tubular shape. An opening is formed in the body. The barrel is behind the body and is crimped to an end portion of an electric wire. A reduced space portion is formed between the barrel and the tab in the longitudinal direction and has an inner space narrowed by hammering a wall from the outside. The reduced space portion has an opening that is smaller than a thickness and a width of the tab to prevent the tab of another male terminal fitting from intruding into the body through the opening.

The hammering of the walls from the outside enables the reduced space portion to be formed by a very simple manufacturing process. Further, it is unnecessary to form a hole in the wall. Hence, the intrusion of the tab into the inside of the body can be prevented and male terminal fittings will not be entangled.

The body is configured to be inserted into a cavity of a housing and is engaged with a lance formed on an inner wall of the cavity. A lance hole is formed in a middle portion of the body to receive the lance, and the reduced space portion faces the lance hole. Thus, the tab of another terminal fitting can not intrude into the inside of the body through the lance hole.

The reduced space portion may be formed by indenting an edge of a side wall of the body that defines the lance hole. Thus, the reduced space portion can be formed easily and the intrusion of the tab into the body can be prevented at an early stage.

The reduced space portion may be formed by indenting portions of the edges of both side walls that face each other in an opposed manner. Thus, compared to a case where only one side wall is indented, it is possible to suppress a reducing amount of each side wall and excellent formability can be acquired.

The opening preferably is formed on a rear end surface of the body and the reduced space portion may be formed in any one of a rear end portion of the body, a connecting portion between the body and the barrel, and a region that extends between the rear end portion of the body portion and the connecting portion. Thus, it is possible to prevent the intrusion of the tab into the inside of the body through the opening in the rear end portion of the body portion.

DETAILED DESCRIPTION OF THE PREFERRED EMBODIMENTS

Figure 8:
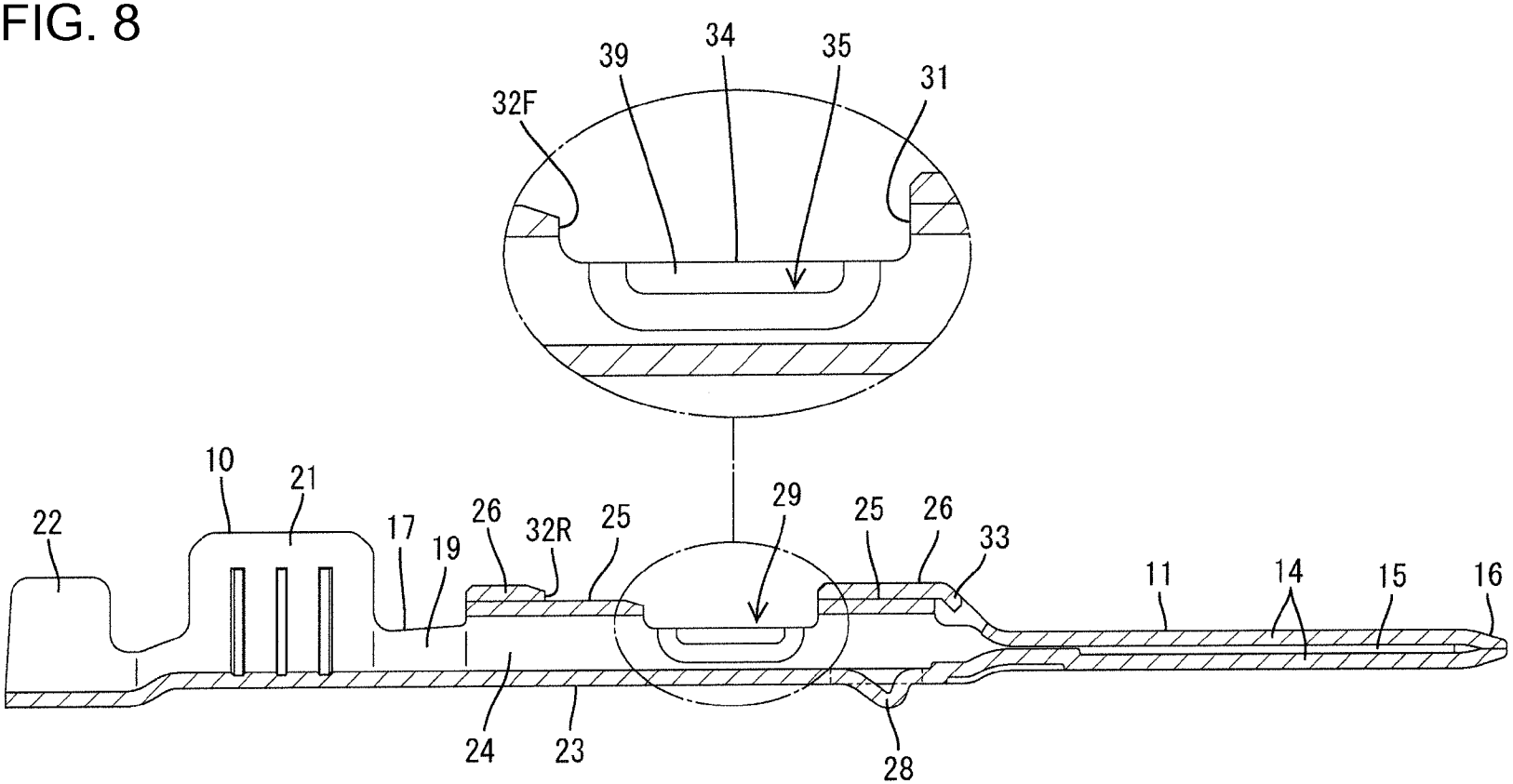
FIG. 8 is a cross-sectional view taken along a line A-A in FIG. 1.
Figure 9:
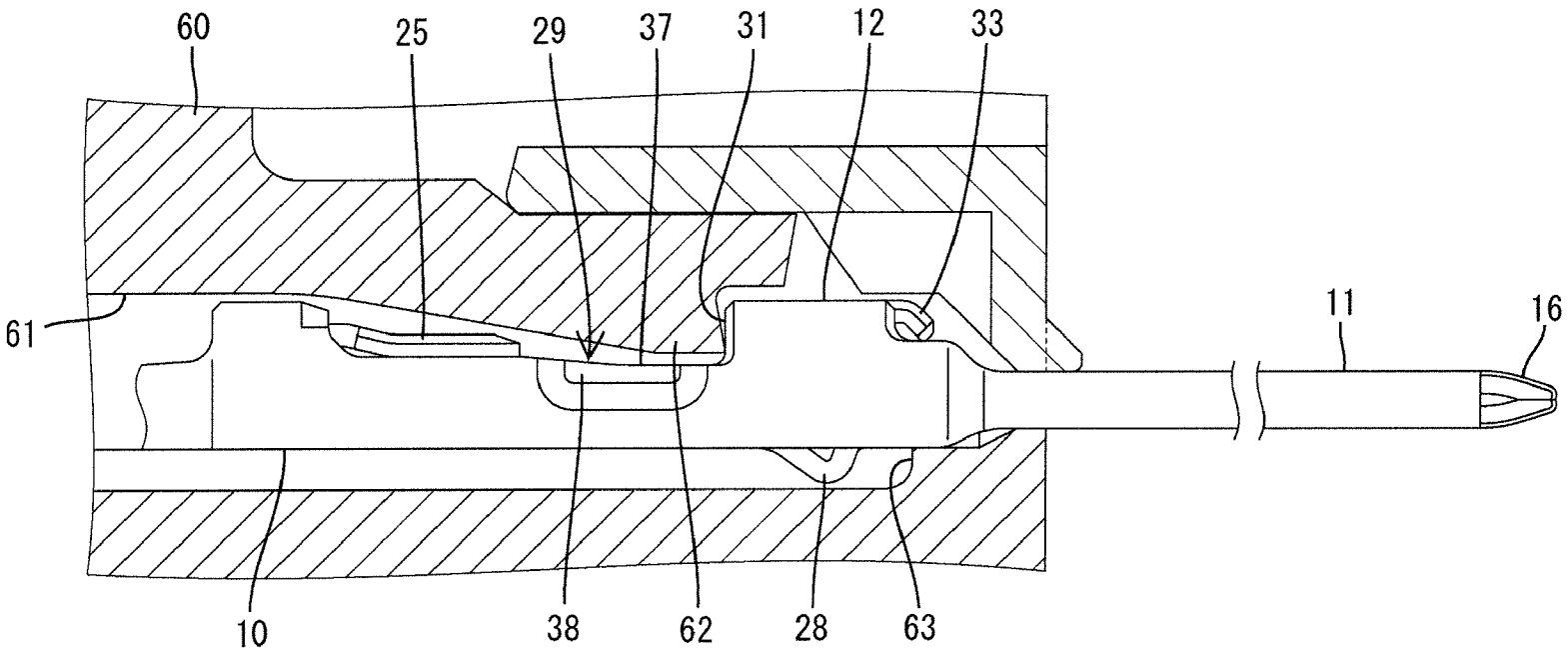
FIG. 9 is an enlarged side view showing a state where the body portion is inserted into a cavity defined in a housing and is engaged with a lance formed on an inner wall of the cavity.

A male terminal fitting in accordance with a first embodiment of the invention is identified by the numeral 10 in FIGS. 1 to 10. The male terminal fitting 10 of this embodiment is formed by bending a unitary piece of electrically conductive metal sheet or the like, and includes a tab 11, a body 12 and a barrel 13. The male terminal fitting 10 is inserted into in a cavity 61 of a housing 60, as shown in FIG. 9, and is engaged by a resiliently deflectable lance 62 formed on an inner wall of the cavity 61.

The male terminal fitting 10 is long and the body is formed in the longitudinal center of the male terminal fitting 10.

The tab 11 has a flattened quadrangular tubular shape and projects forward from a front end of the body 12. As shown in FIG. 8, the tab 11 has two opposed long walls 14 that face each other in the height direction of the tab 11 and two opposed short walls 15 that face each other in the width direction of the tab 11. The long-side walls 14 define a width of the tab 11 and the short side walls 15 define a thickness of the tab 11 in the height direction. The width is greater than the thickness. Distal end portions of the long-side walls 14 are bent toward one another in a tapered shape to form introducing portions 16 on a distal end portion of the tab 11. The introducing portions 16 guide the male terminal fitting 10 into the cavity 61. The tab 11 is brought into contact with a counterpart female terminal fitting (not shown in the drawing) during a fitting engagement operation of the housing 60, and is connected electrically with the counterpart female terminal fitting.

Figure 1:
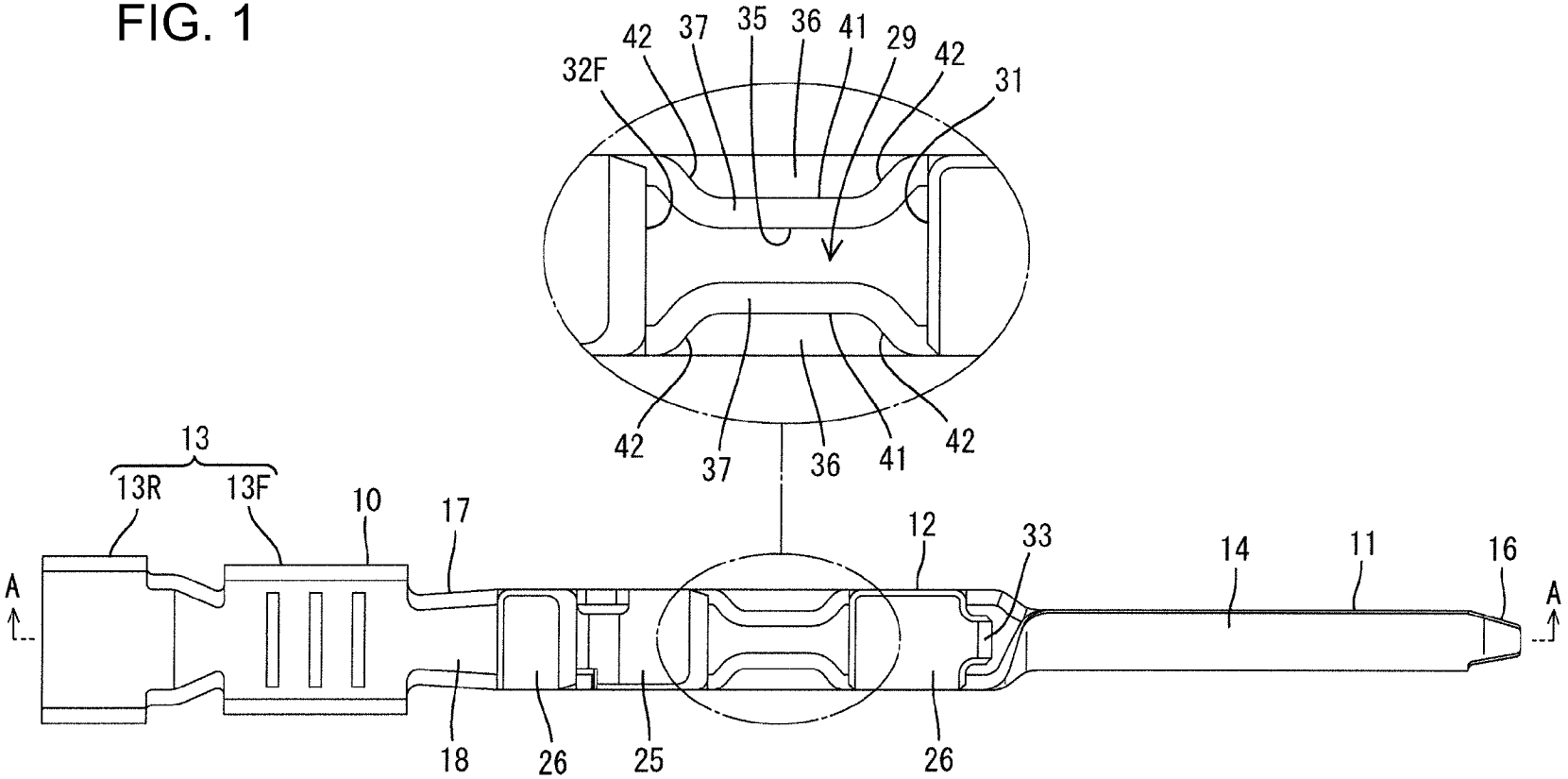
FIG. 1 is a plan view of a male terminal fitting according to a first embodiment of the invention.
Figure 2:
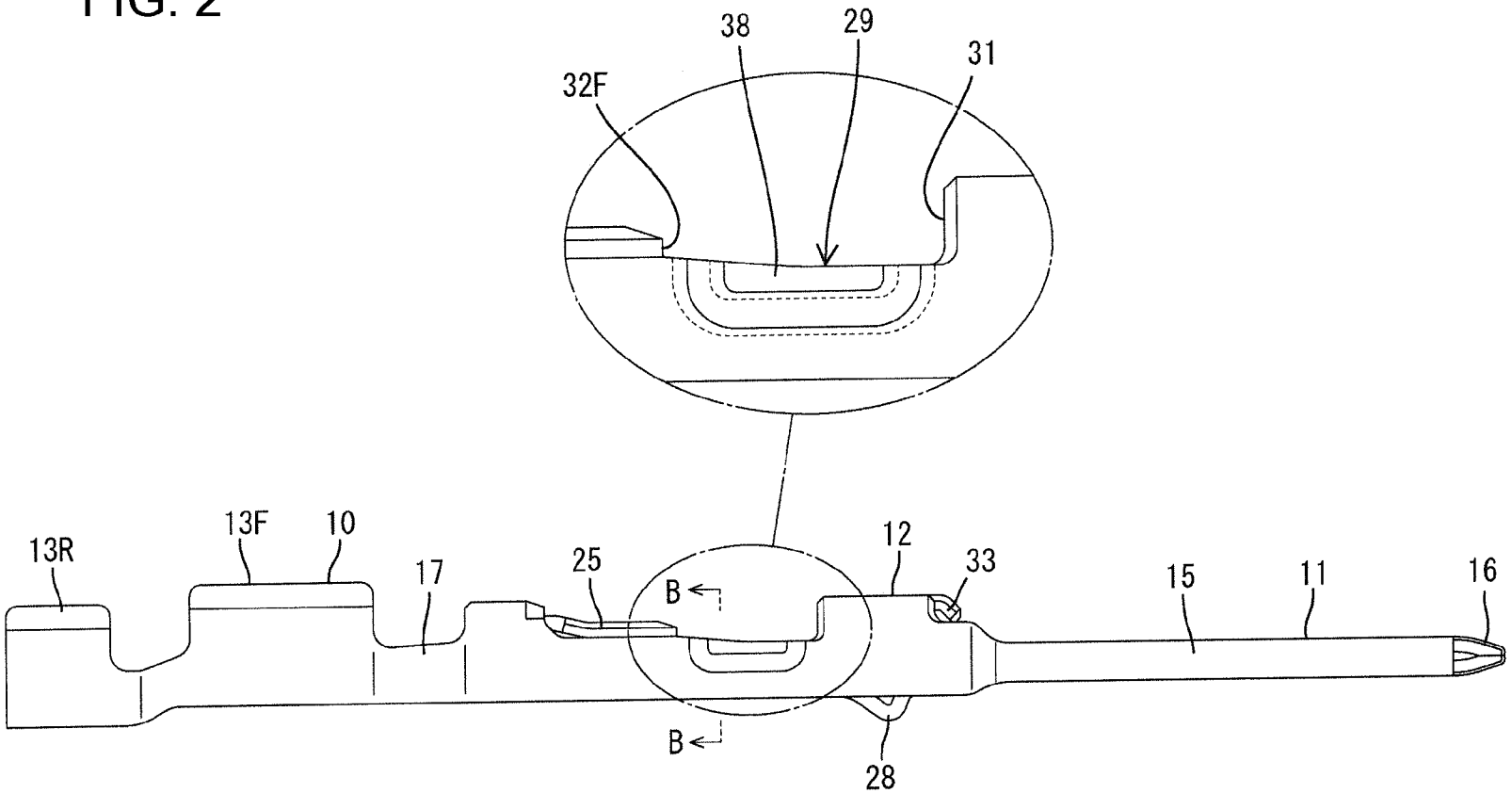
FIG. 2 is a side view of the male terminal fitting.
Figure 3:
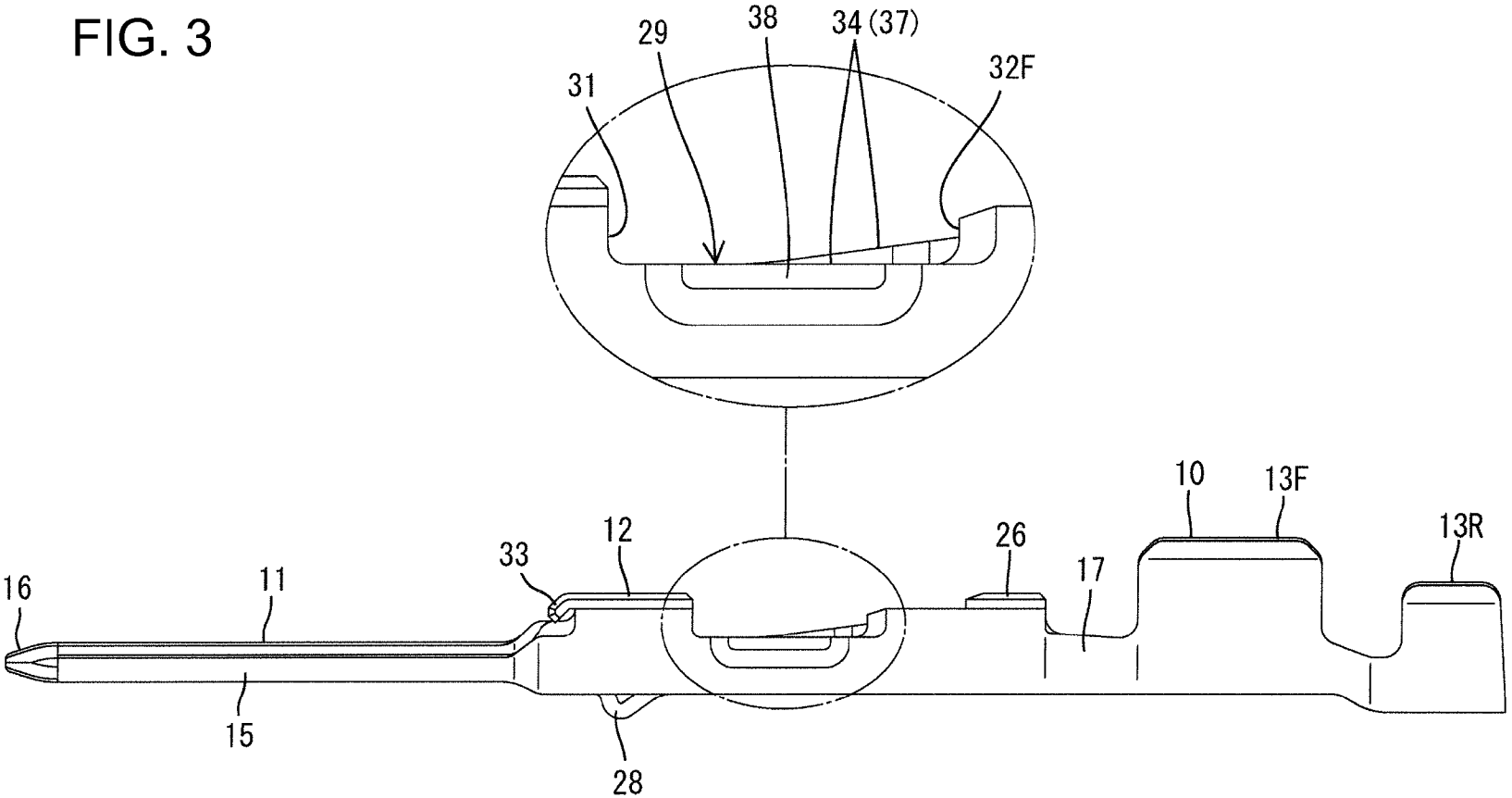
FIG. 3 is another side view of the male terminal fitting.

The barrel 13 is arranged behind the body 12, as shown in FIG. 1. A connecting portion 17 is formed between the barrel 13 and the body 12, and connects the barrel 13 and the body 12 to each other. The connecting portion 17 has a bottom wall 18 and left and right side walls 19 that are raised from the opposite widthwise sides of the bottom wall 18. The barrel 13 includes a front barrel 13F and a rear barrel 13R. The front barrel 13F includes left and right front crimping members 21 and is crimped into connection with a core wire exposed at an end portion of an electric wire (not shown). The rear barrel 13R includes left and right rear crimping members 22 and is crimped into connection with an insulation cover at the end portion of the electric wire.

Figure 4:
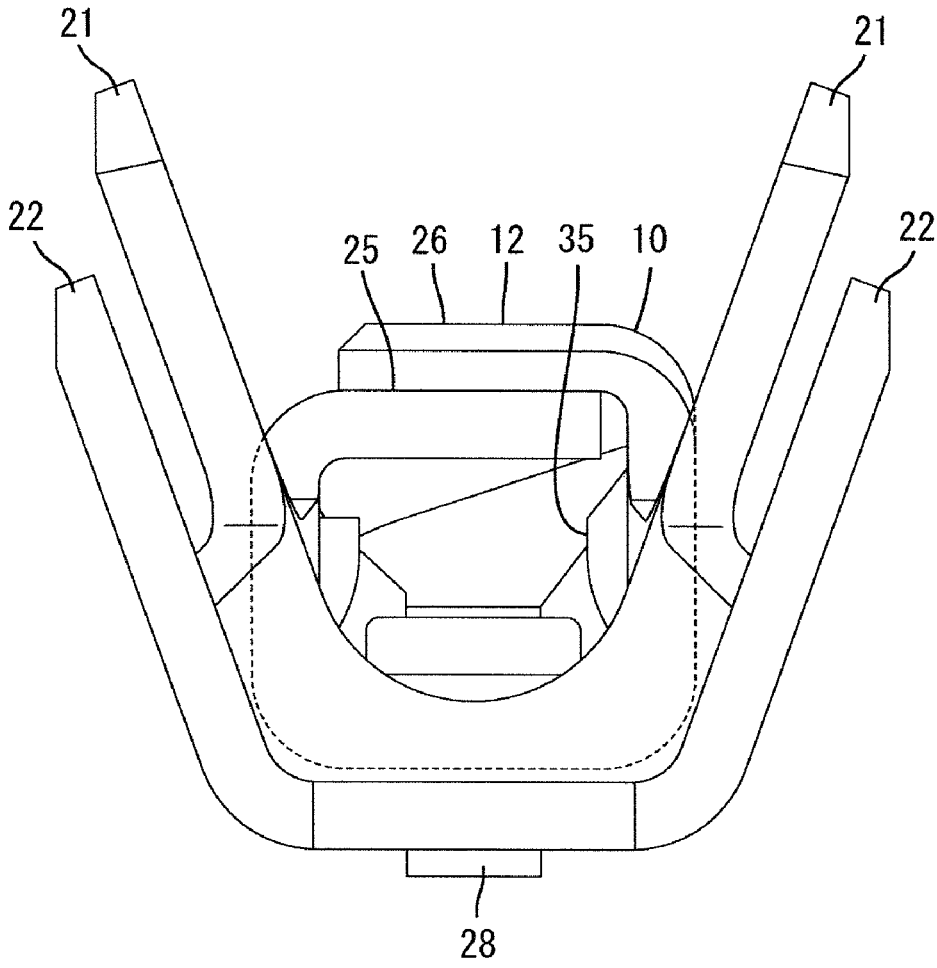
FIG. 4 is a back view of the male terminal fitting.
Figure 5:
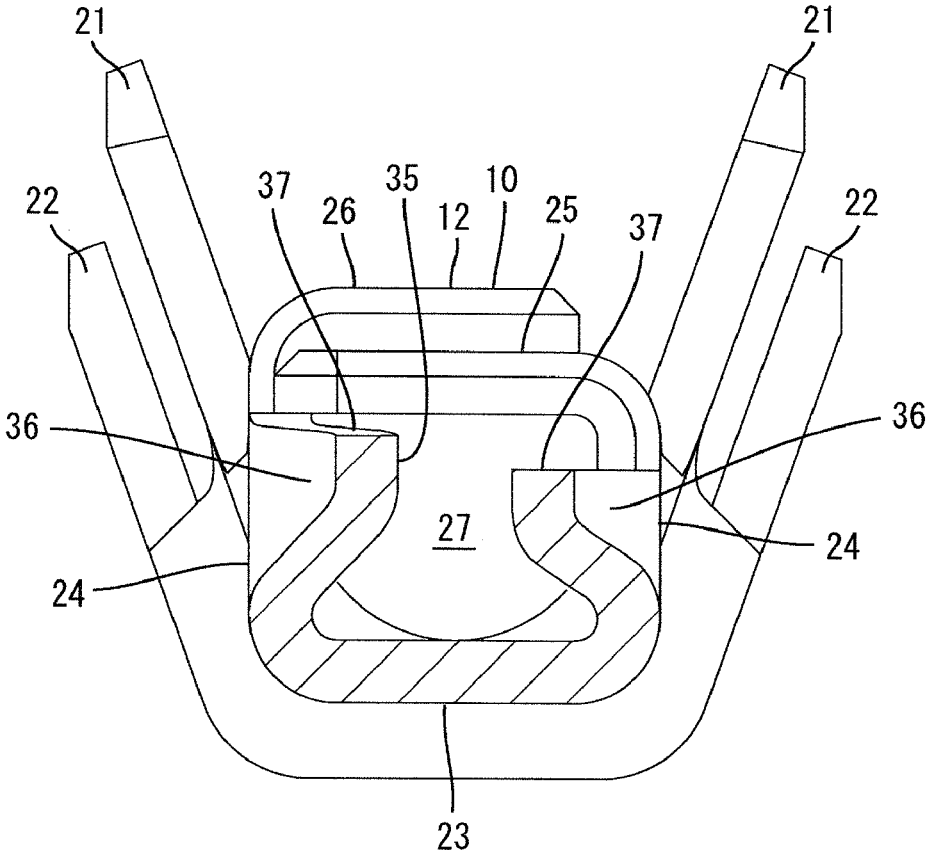
FIG. 5 is a cross-sectional view take along a line B-B in FIG. 2.
Figure 6:
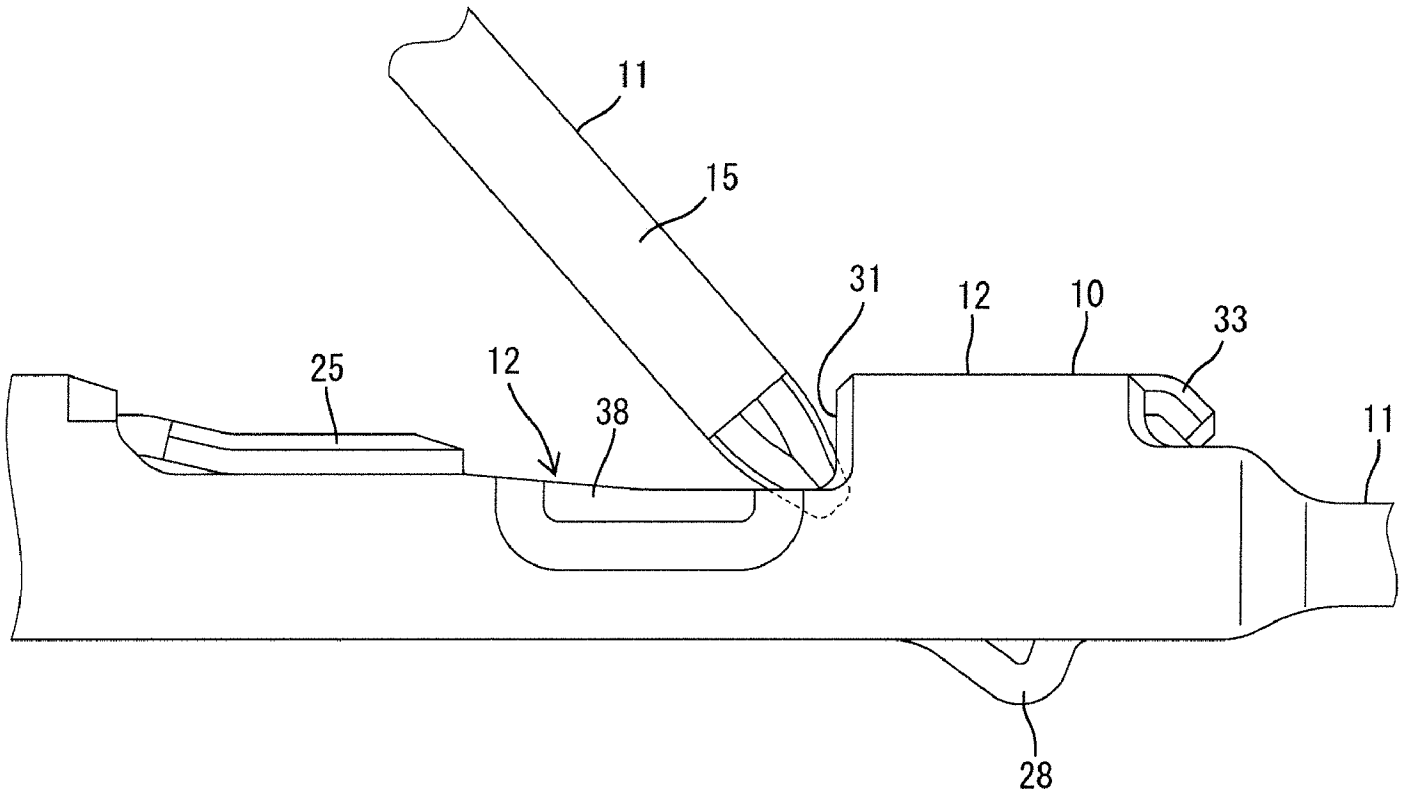
FIG. 6 is an enlarged side view showing a state where the intrusion of a tab into the inside of a body portion is prevented.
Figure 7:
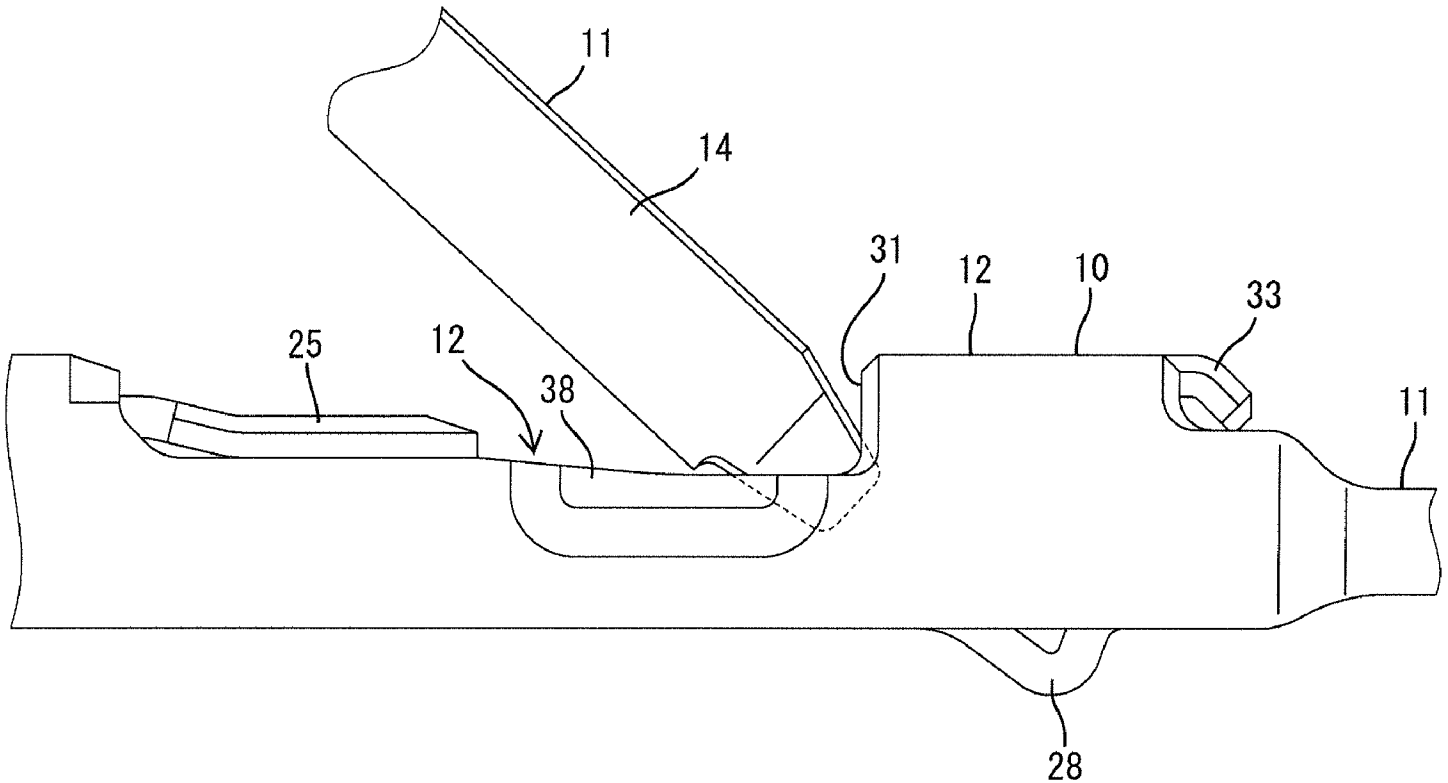
FIG. 7 is an enlarged side view showing a state where the tab is rotated by 90 degrees about an axis thereof from a state shown in FIG. 6.

The body 12 has an approximately quadrangular tubular shape, as shown in FIGS. 4 and 5 and includes a base wall 23, first and second side walls 24 raised from opposite widthwise sides of the base wall 23, inner ceiling walls 25 bent from a raised end of the first side wall 24 toward a raised end of the second side wall 24, and outer ceiling walls 26 bent from a raised end of the second side wall 24 toward a raised end of the first side wall 24 to cover the inner ceiling walls 25 from the outside. The base wall 23 is formed contiguously with both the bottom wall 18 of the connecting portion 17 and the lower long-side wall 14 of the tab 11. The side walls 24 are formed contiguously with both the side walls 19 of the connecting portion 17 and the short-side walls 15 of the tab 11. The upper long-side wall 14 of the tab 11 joins with the second side wall 24. An opening 27 is formed at a rear end of the body 12.

As shown in FIG. 9, a triangular stabilizer 28 projects from a widthwise center of a front end portion of the base wall 23 and is formed by cutting the base wall 23 and deforming the cut part outwardly. A guide groove 63 is formed along the cavity 61 of the housing 60. The stabilizer 28 slides on a surface of the guide groove 63 while inserting the male terminal fitting 10 into the cavity 61 to guide the insertion operation of the male terminal fitting 10. The stabilizer 28 also prevents the male terminal fitting 10 from being inserted into the cavity 61 in an improper orientation.

The inner and outer ceiling walls 25 and 26 are divided in the longitudinal direction to define a lance hole 29 in the lengthwise center portion of the body 12. A distal end of the lance 62 is fit resiliently in the lance hole 29 from above when the male terminal fitting 10 is inserted properly into the cavity 61. Front parts of the inner and outer ceiling walls 25 and 26 have rear end peripheries 31 that extend in the width direction. Both rear end peripheries 31 are at the same position in the longitudinal direction and define a front periphery of the lance hole 29. Further, rear parts of the inner and outer ceiling walls 25 and 26 have front end peripheries 32F, 32R arranged in the width direction. The front end periphery 32F of the inner ceiling wall 25 is arranged in front of the front end periphery 32R of the outer ceiling wall 26 so that the front end periphery 32F of the inner ceiling wall 25 defines a rear periphery of the lance hole 29.

As described above, the rear end portion and the front end portion of the body 12 have the double-wall structure consisting of the inner and outer ceiling walls 25 and 26, and a portion of the body 12 between the rear end portion and the lance hole 29 has the single-wall structure consisting of only the inner ceiling wall 25. A hanging member 33 extends obliquely down the front end of the front outer ceiling wall 26 and extends obliquely to cover the front end periphery of the front inner ceiling wall 25. The hanging member 33 fills a gap defined between the body portion 12 and the tab 11 and, at the same time, the hanging member 33 ensures a smooth insertion of the body 12 into the cavity 61.

Recesses 34 are cut on the raised ends of both side walls 24 and define the widthwise edges of the lance hole 29. With respect to these recessed portions 34, the recess 34 formed on the first side wall 24 has an end surface 37 with a fixed height that extends along the longitudinal direction with a depth larger than a thickness of the inner ceiling wall 25. The recess 34 on the second side wall 24 has an end surface 37 that gradually deepens in a rear to front direction end, with a fixed height in a middle portion thereof, and a depth equal to or more than a thickness of the inner ceiling wall 25.

As shown in FIG. 1, a reduced space portion 35 is formed on the body 12 at a position which corresponds to the lance hole 29. The reduced space portion 35 is formed by hammering inward edges 36 of opposed regions of the side walls 24 that include the end surfaces 37 so that an inner space of the body 12 is narrowed. The hammering forms recesses 38 on outer surfaces of the edges 36 of both side walls 24 (see FIG. 2), and projections 39 are formed on inner surfaces of the edges 36 of both side walls 24 at a position where the projecting portions 39 face the recesses 38 in a back-to-back posture (see FIG. 8). Shapes of portions other than the edges 36 are not changed by hammering. The end surfaces 37 of the edges 36 of both side walls 24 formed by the hammering include left and right straight portions 41 that extend approximately parallel to each other in the longitudinal direction and four inclined portions 42 that are arranged in pairs in the longitudinal and lateral directions to expand obliquely with respect to the longitudinal direction from longitudinal ends of the straight portions 41 to the side walls 24. The inclined portions 42 are inclined at the same angle to the longitudinal direction. The reduced space portion 35 has a symmetrical shape with respect to a center axis extending in the longitudinal direction. An opening width between the straight portions 41 is smaller than a thickness and width of the tab 11. Further, an opening of a front region of the reduced space portion 35, which is defined by the front inclined portion 42 and a front periphery of the lance hole 29 (both rear end peripheries 31 of the inner ceiling wall 25 and the outer ceiling wall 26 on a front side), and an opening size of a rear region of the reduced space portion 35, which is defined by the rear-side inclined portion 42 and a rear periphery of the lance hole 29 (front end periphery 32F of the inner ceiling wall 25), also are smaller than the thickness and width of the tab 11. Thus, the tab 11 of another male terminal fitting 10 cannot penetrate the reduced space portion 35.

Figure 10:
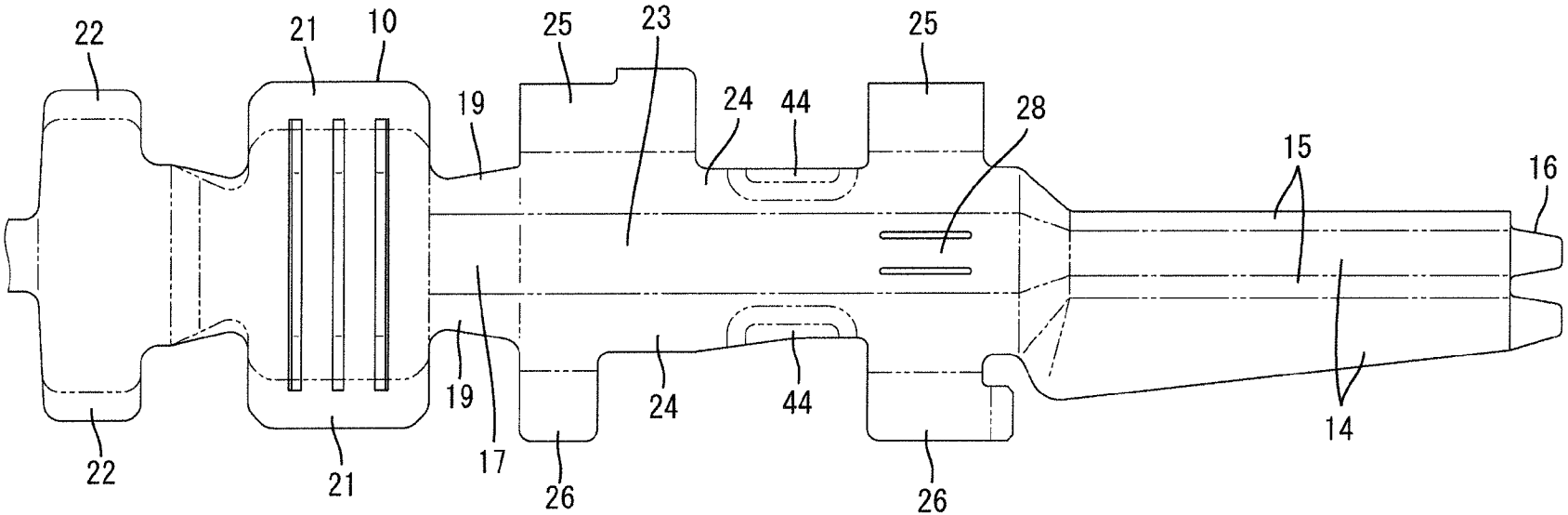
FIG. 10 is a developed view of the male terminal fitting.

The male terminal fitting 10 initially is blanked from an electrically conductive metal sheet to form the shape shown in FIG. 10. The reduced space portions 35 are formed in press regions 44 in a press step that blanks the male terminal fitting 10.

The body 12 of the male terminal fitting 10 is inserted into the cavity 61 of the housing 60, as shown in FIG. 9. Thus, the distal end of the lance 62 is fit resiliently into the lance hole 29 of the body 12 so that the lance 62 engages the front periphery of the lance hole 29 to prevent removal of the male terminal fitting 10 from the cavity 61. Here, the distal end of the lance 62 is above the end surfaces 37 of edges 36 of the side walls 24 and within the thickness of the inner ceiling wall 25 on a rear side.

There is a possibility that the tab 11 of another male terminal fitting 10 will intrude through the lance hole 29 and into the inside of the body 12 when the male terminal fitting 10 is transported with other male terminal fittings 10 so that the male terminal fittings 10 entangle with each other. However, the reduced space portion 35 faces the lance hole 29 and the distal end of the tab 11 will contact the end surfaces 37 of the edges 36 that define the reduced space portion 35, or more specifically will contact front end portions of both straight portions 41 and the front inclined portions 42 from behind. Accordingly, the tab 11 will not intrude into the body 12 and the male terminal fittings 10 will not become entangled. The opening of the reduced space portion 35 is smaller than the thickness and the width of the tab 11 to prevent intrusion of the tab 11 into the body portion 12 when the thickness (short walls 15) of the tab 11 is directed in the width direction of the reduced space portion 35 (see FIG. 7) and also when the width (long walls 14) of the tab 11 is directed in the width direction of the reduced space portion 35 (see FIG. 6).

The reduced space portion 35 does not make the male terminal fitting 10 complicated, and it is unnecessary to form an opening on a separate wall of the body 12, as in the above-described prior art. Hence, the intrusion of the tab 11 into the body 12 surely is prevented. Still further, the reduced space portion 35 is formed by hammering out the edges 36 of both side walls 24 and hence increases the strength of the body 12.

The reduced space portion 35 is formed by indenting the edges 36 of both side walls 24 and hence, the reduced space portion 35 can be formed easily, and the intrusion of the tab 11 into the body 12 can be prevented at an early stage. Further, the reduced space portion 35 is formed by indenting the portions of the edges 36 of both side walls 24 that face each other. Thus, less deformation is required than if only one side wall 24 was indented and excellent formability is assured.

Figure 11:
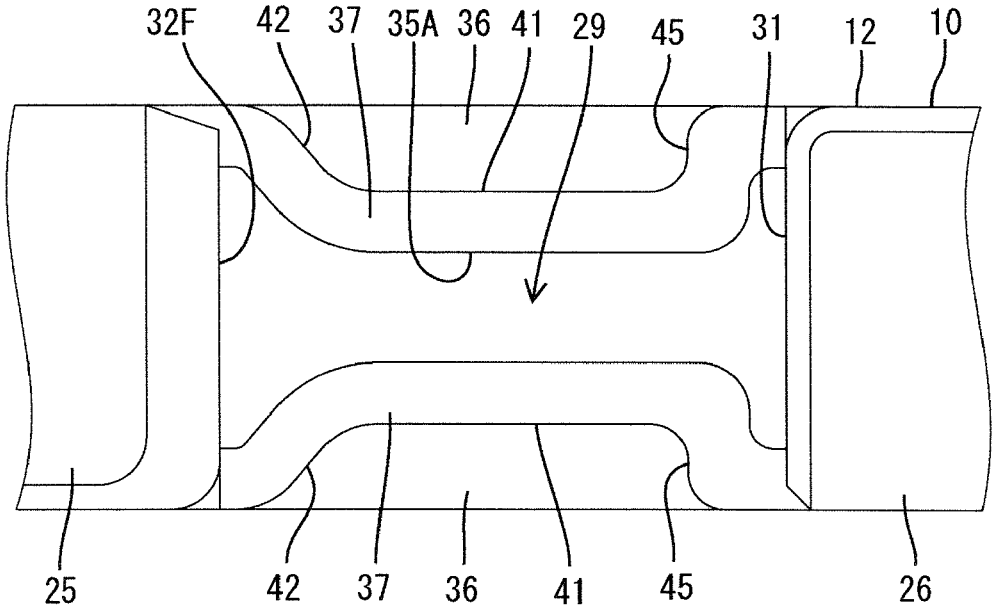
FIG. 11 is an enlarged plan view of a male terminal fitting according to a second embodiment.

FIG. 11 shows the second embodiment of the invention and has a reduced space portion 35A that differs from the reduced space portion 35 of the first embodiment. Other constitutions are substantially the same as the first embodiment and similar or identical parts are given same reference numbers, but are not described again.

The reduced space portion 35A is formed by hammering out edges 36 of both side walls 24 toward the inside from the outside in the same manner as the first embodiment. However, the hammering of the end surfaces 37 of the edges 36 of the side walls 24 forms left and right straight portions 41 that extend approximately parallel to each other in the longitudinal direction, inclined portions 42 that obliquely expand with respect to the longitudinal direction from rear ends of the straight portions 41 to the side walls 24, and orthogonally intersecting portions 45 that extend in the width direction orthogonal to the longitudinal direction from front ends of both straight portions 41 to both side walls 24 are formed. An opening size of a front region of the reduced space portion 35A, which is defined by the orthogonally intersecting portions 45 and a front periphery of a lance hole 29 (both rear end peripheries 31 of an inner ceiling wall 25 and an outer ceiling wall 26 on a front side) is sufficiently smaller than a thickness and a width of a tab 11.

Accordingly, a tab 11 that has a distal end directed frontward is brought into contact with the orthogonally intersecting portions 45 in the second embodiment and hence cannot intrude into the body 12.

Figure 12:
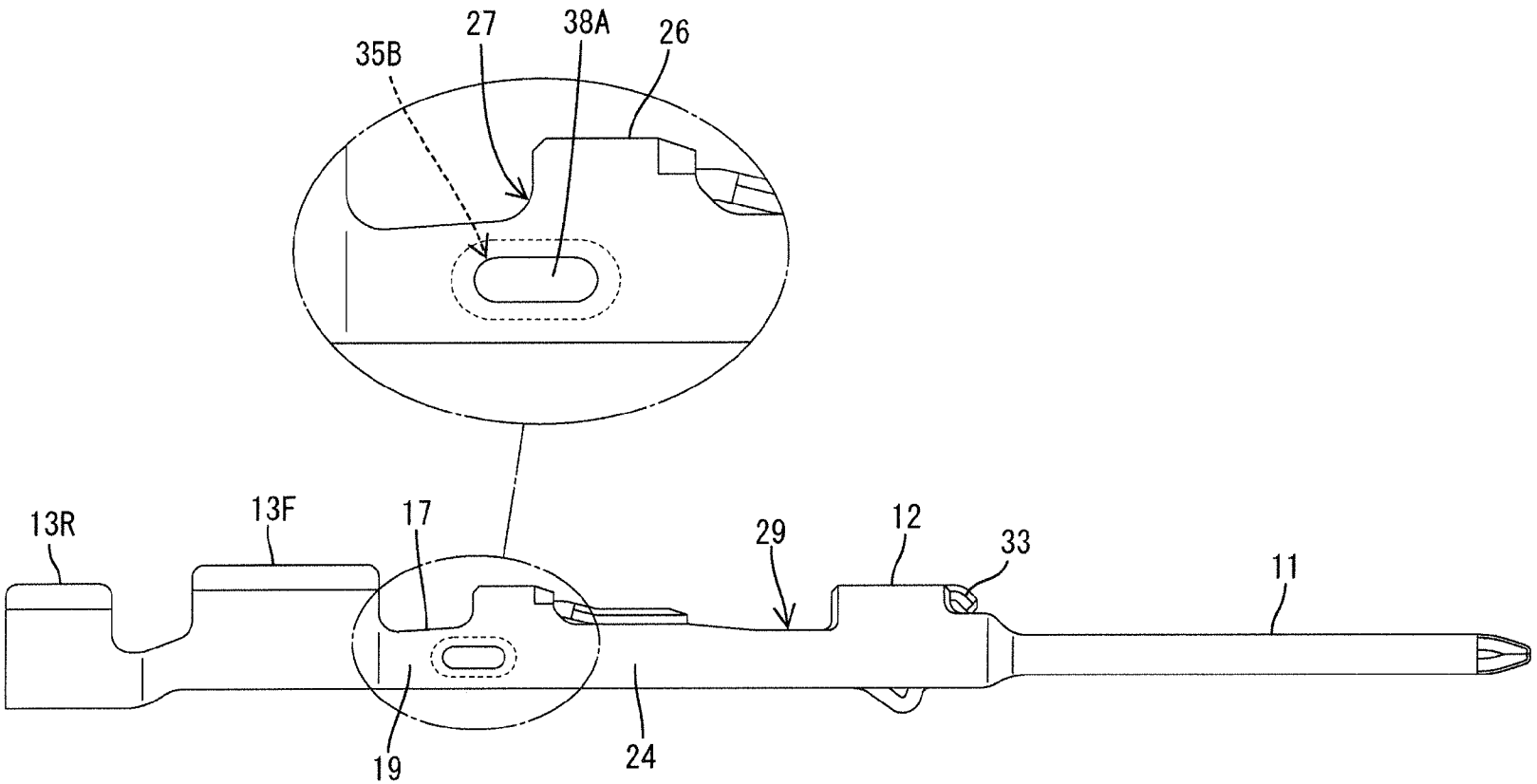
FIG. 12 is a side view of a male terminal fitting according to a third embodiment.

FIG. 12 shows the third embodiment of the invention. The reduced space portion 35B of the third embodiment is at a position that corresponds to an opening 27 at a rear end of a body 12 rather than at a position that corresponds to a lance hole 29.

The reduced space portion 35B is formed by hammering a region that extends between both side surfaces 19 of a connecting portion 17 and both side walls 24 of the body 12 from the outside so that an inner space of the extending region is slightly narrower than a thickness and a width of a tab 11. The reduced space portion 35B is formed in the middle of both side surfaces 19 and both side walls 24 in the height direction. The hammering forms longitudinally elongated elliptical recesses 38A on outer surfaces of both side surfaces 19 and a projections (not shown) on inner surfaces of both side surfaces 19 at a position where the projections face the recesses 38A in a back-to-back posture.

According to the third embodiment, a distal end of the tab 11 will contact end surfaces of the projections that define the reduced space portion 35B and hence the tab 11 cannot intrude through the opening and into the body 12.

The invention is not limited to the above described and illustrated embodiment. For example, the following embodiments are also embraced by the scope of the invention as defined by the claims.

The reduced space portion may be formed by hammering middle portions of the side walls of the body in the height direction from the outside.

The reduced space portion may be formed by hammering the base wall of the body or the bottom wall of the connecting portion from the outside.

The reduced space portion may be formed by hammering only a portion of the connecting portion or only a rear end portion of the body from the outside so that the tab cannot intrude into the body through the rear opening of the body.

In the first embodiment, the inclination angle with respect to the longitudinal direction of the inclined portion on a front end may exceed the inclination angle with respect to the longitudinal direction of the inclined portion on a rear end. Alternatively, the inclination angle with respect to the longitudinal direction of the inclined portion on a rear end may exceed the inclination angle with respect to the longitudinal direction of the inclined portion on a front side.

The reduced space portion may be defined by walls that are bent inwardly in an arcuate shape by hammering both side walls from the outside.

The invention also is applicable to a male terminal fitting with configurations of the first and third embodiments to prevent the tab from intruding into the body through the rear end of the body as well as through the lance hole.

What is claimed is:

1. A male terminal fitting formed of an electrically conductive metal sheet and having opposite front and rear ends, the male terminal fitting comprising:

a tab at the front end and connectable with a female terminal fitting;

a barrel at the rear end and crimped to an end of an electric wire; and a tubular body between the tab and the barrel and having at least one opening, at least one wall of the tubular body being deformed inward toward an opposite wall of the tubular body in proximity to the opening to define a reduced space portion with entry dimensions selected to prevent a tab of another male terminal fitting from intruding through the opening and into the body, at least part of the reduced spaced portion being at a position between the front and rear ends of the male terminal fitting corresponding to a position of the at least one opening.

2. The male terminal fitting of claim 1, wherein the opening is a lance hole formed in a middle portion of the body and disposed for engaging a lance of a housing when the male terminal fitting is inserted into a cavity of the housing, the reduced space portion being formed at a position facing the lance hole.

3. The male terminal fitting of claim 2, wherein the reduced space portion is formed by indenting an edge portion of at least one side wall of the body defining the lance hole.

4. The male terminal fitting of claim 3, wherein the reduced space portion is formed by indenting edges of two opposed side walls.

5. The male terminal fitting of claim 4, wherein the edges of two opposed side walls are indented substantially symmetrically to define the reduced space portion.

6. The male terminal fitting of claim 4, wherein at least parts of the edges of the side walls that are indented to form the reduced space portion are substantially parallel.

7. The male terminal fitting of claim 1, wherein the opening is formed at a rear end of the body, and the reduced space portion is formed in at least one of a rear end of the body, a connecting portion between the body and the barrel, and a region that extends between the rear end of the body and the connecting portion.

8. The male terminal fitting of claim 7, wherein the reduced space portion is spaced from edges of the terminal fitting.

9. A male terminal fitting formed of an electrically conductive metal sheet and having opposite front and rear ends, the male terminal fitting comprising:

a tab at the front end and connectable with a female terminal fitting;

a barrel at the rear end and connectable to an electric wire;

a tubular body between the tab and the barrel and having at least one opening; and two opposed walls between the tab and the barrel being deformed inward and toward one another in proximity to the opening to define a reduced space portion with entry dimensions to prevent a tab of another male terminal fitting from intruding through the opening and into the body, at least part of the reduced spaced portion being at a position between the front and rear ends of the male terminal fitting corresponding to a position of the at least one opening.

10. The male terminal fitting of claim 9, wherein the reduced space portion is formed in the body.

11. The male terminal fitting of claim 9, wherein at least part of the reduced spaced portion is on a connecting portion between the body and the barrel.

* * * * *